United States Patent [19]

Hasegawa et al.

[11] Patent Number: 4,492,206

[45] Date of Patent: Jan. 8, 1985

[54] DEVICE FOR INTAKE AIR TEMPERATURE-DEPENDENT CORRECTION OF AIR/FUEL RATIO FOR INTERNAL COMBUSTION ENGINES

[75] Inventors: Shumpei Hasegawa, Niiza; Akihiro Yamato, Sayama, both of Japan

[73] Assignee: Honda Motor Co., Ltd., Tokyo, Japan

[21] Appl. No.: 442,614

[22] Filed: Nov. 18, 1982

[30] Foreign Application Priority Data

Nov. 20, 1981 [JP] Japan ..... 56-186631

[51] Int. Cl.[3] ..... F02M 17/00

[52] U.S. Cl. ..... 123/491; 123/179 L

[58] Field of Search ..... 123/491, 492, 494, 179 L

[56] References Cited

U.S. PATENT DOCUMENTS

| | | | |
|---|---|---|---|
| 3,589,345 | 7/1969 | Benson | 123/498 |
| 3,982,503 | 9/1976 | Keranen | 123/494 |
| 4,352,158 | 9/1982 | Date | 123/492 |
| 4,357,923 | 11/1982 | Hideg | 123/492 |

*Primary Examiner*—Ronald B. Cox

*Attorney, Agent, or Firm*—Arthur L. Lessler

[57] ABSTRACT

A device for correcting the air/fuel ratio of a mixture being supplied to an internal combustion engine, by the use of a correction coefficient which has its value determined as a function of intake air temperature in the intake pipe of the engine. The correction coefficient has a predetermined constant value at intake air temperature higher than a predetermined value, and has its value increasing as the intake air temperature decreases from the above predetermined value. A decrease in the evaporation rate of fuel being supplied to the engine at low intake air temperature is thus compensated for by the above air/fuel ratio correction.

2 Claims, 10 Drawing Figures

FIRST PROGRAM
1
SECOND PROGRAM
2
START CONTROL
3
BASIC CONTROL
4
ASYNCHRONOUS CONTROL
5
TiCRM,TiCRS TABLES
6,7
KNe TABLE
8
TV TABLE
9
BASIC Ti MAP
10
ACC/DEC SUBROUTINE
11
COEFFICIENT CALCULATING TABLES, SUBROUTINES
12
TV TABLE
9
TiA TABLE
13
KTW TABLE
14
TV TABLE
9

FIG. 7
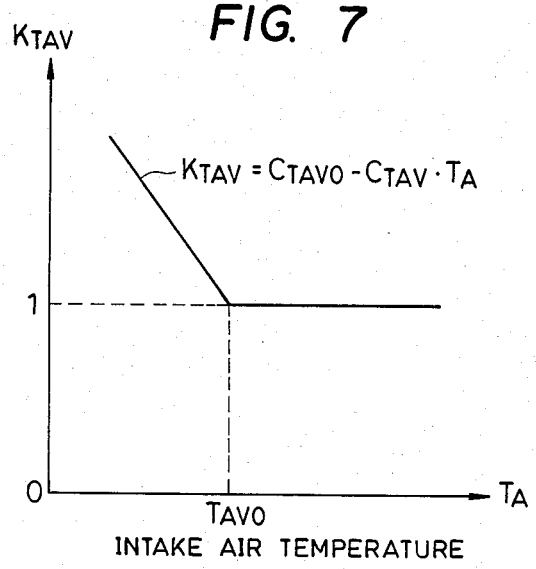
FIG. 9
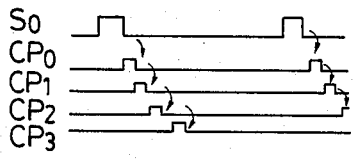
FIG. 10
| TA | TAi | ---- | TA2 | TA1 | TAV0 |
|---|---|---|---|---|---|
| KTAV | KTAVi | ---- | KTAV2 | KTAV1 | 1.0 |

DEVICE FOR INTAKE AIR TEMPERATURE-DEPENDENT CORRECTION OF AIR/FUEL RATIO FOR INTERNAL COMBUSTION ENGINES

BACKGROUND OF THE INVENTION

This invention relates to an air/fuel ratio correcting device for an internal combustion engine, which is adapted to correct the air/fuel ratio of an air/fuel mixture being supplied to the engine, depending upon the intake air temperature, so as to maintain the air/fuel ratio to a desired value.

A fuel supply control system adapted for use with an internal combustion engine, particularly a gasoline engine has been proposed e.g. by U.S. application Ser. No. 348,648, now U.S. Pat. No. 4,445,483, assigned to the assignee of the present application, which is adapted to determine the valve opening period of a fuel injection device for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

In internal combustion engines, the evaporation rate of fuel decreases with a decrease in the intake air temperature. Therefore, when the intake air temperature is low, the air/fuel ratio can be leaner than a desired value. In order to maintain the air/fuel ratio at values appropriate for operating conditions of the engine by means of the aforementioned fuel supply control system, it is necessary to correct the quantity of fuel being supplied to the engine in response to changes in the intake air temperature.

OBJECTS AND SUMMARY OF THE INVENTION

It is the object of the invention to provide a device for intake air temperature-dependent air/fuel ratio correction, which is adapted to compensate for a decrease in the evaporation rate of fuel being supplied to the engine when the intake air temperature is low, to improve the operational stability and driveability of the engine.

The present invention provides an air/fuel ratio correcting device forming part of a fuel supply control system which is adapted to determine a basic value of the air/fuel ratio of an air/fuel mixture being supplied to an internal combustion engine as a function of at least one parameter representing operating conditions of the engine. The air/fuel ratio correcting device comprises: an intake air temperature sensor for detecting a value of intake air temperature in the intake pipe of the engine; means for determining a value of a correction coefficient as a function of a value of the intake air temperature detected by the intake air temperature sensor; and means for correcting a determined basic value of the air/fuel ratio by an amount corresponding to a value of the correction coefficient determined by the above correction coefficient determining means. The correction coefficient determining means is adapted to determine the value of the correction coefficient in such a manner that the determined value has a predetermined constant value when the intake air temperature has a value higher than a predetermined value, and has its value increasing as the intake air temperature has its value decreasing from the above predetermined value.

The above and other objects, features and advantages of the invention will be more apparent from the ensuing detailed description taken in connection with the accompanying drawings.

BRIEF DESCRIPTION OF THE DRAWINGS

FIG. 6 is a graph showing the relationship between the intake air temperature and the evaporation quantity of fuel droplets, obtained at the termination of a certain period of time to;

FIG. 7 is a graph showing the relationship between the intake air temperature and the value of an intake air temperature-dependent correction coefficient KTAV;

FIG. 9 is a timing chart showing the relationship between TDC pulses SO inputted to the sequential clock generator in FIG. 8 and clock pulses generated from the same generator; and FIG. 10 is a view showing a map of the intake air temperature TA and the intake air temperature-dependent correction coefficient KTAV.

DETAILED DESCRIPTION

The air/fuel ratio correcting device according to the present invention will now be described in detail with reference to the drawings.

Figure 1:
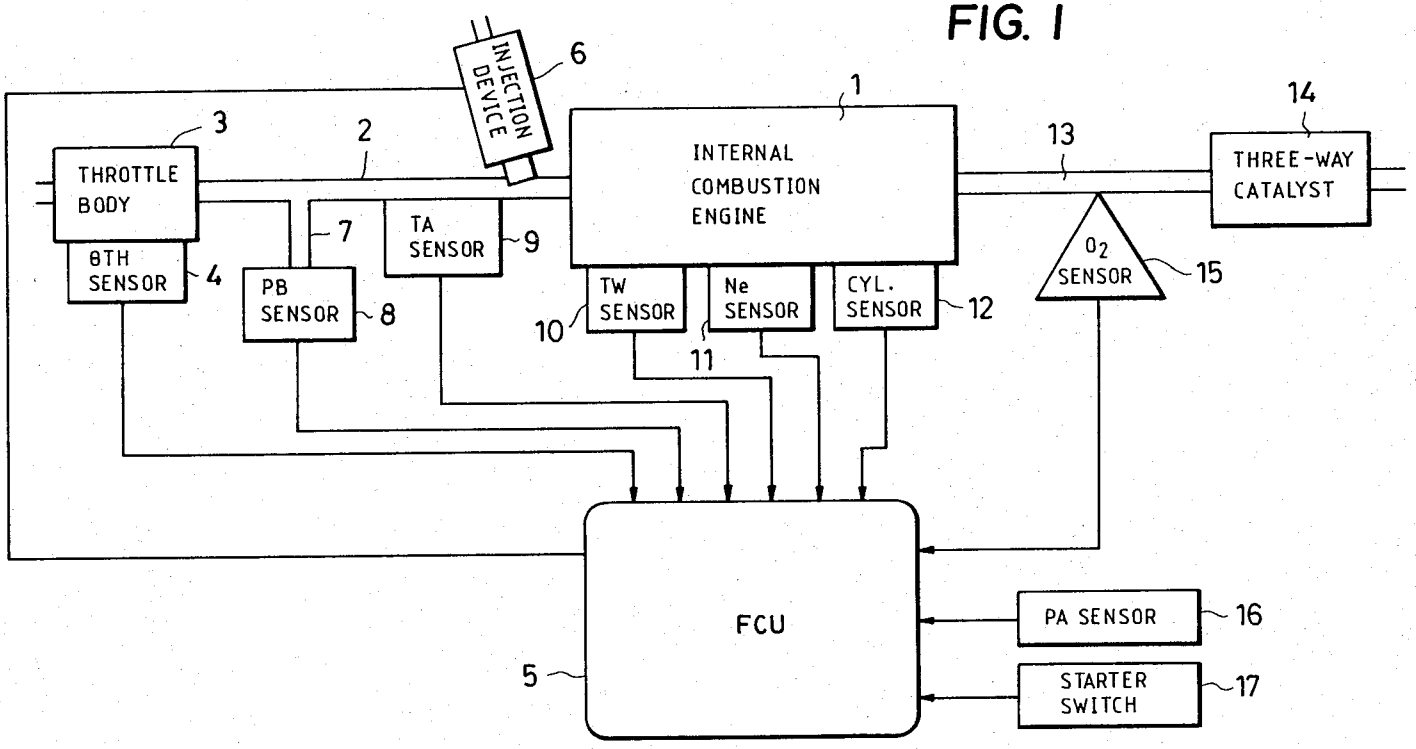
FIG. 1 is a block diagram illustrating a fuel supply control system inclusive of an air/fuel ratio correcting device according to the present invention.

Referring first to FIG. 1, there is illustrated the whole arrangement of a fuel injection control system for internal combustion engines, inclusive of the air/fuel ratio correcting device according to the present invention. Reference numeral 1 designates an internal combustion engine which may be a four-cylinder type, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening sensor 4 is connected to the main throttle valve for detecting its valve opening and converting same into an electrical signal which is supplied to an electronic control unit (hereinafter called "ECU") 5.

A fuel injection device 6 is arranged in the intake pipe 2 at a location between the engine 1 and the throttle body 3, which comprises main injectors and a subinjector, all formed by electromagnetically operated fuel injection valves, none of which is shown in FIG. 1. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. The fuel injection device 6 is connected to a fuel pump, not shown. The main injectors and the subinjector are electrically connected to the ECU 5 in a manner having their valve opening periods or fuel injection quantities controlled by driving signals supplied from the ECU 5.

On the other hand, an absolute pressure sensor 8 communicates through a conduit 7 with the interior of the main intake pipe at a location immediately downstream of the main throttle valve of the throttle body 3. The absolute pressure sensor 8 is adapted to detect absolute pressure in the intake pipe 2 and apply an electrical signal indicative of detected absolute pressure to the ECU 5. An intake air temperature sensor 9 is arranged in the intake pipe 2 at a location downstream of the absolute pressure sensor 8 and also electrically connected to the ECU 5 for supplying thereto an electrical signal indicative of detected intake air temperature.

An engine temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., a pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and a starting switch 17 of the engine, respectively, for supplying an electrical signal indicative of detected atmospheric pressure and an electrical signal indicative of its own on and off positions to the ECU 5.

Next, details of the manner of air/fuel ratio control of the fuel supply control system outlined above will now be described with reference to FIG. 1 referred to above as well as FIGS. 2 through 10.

Figure 2:
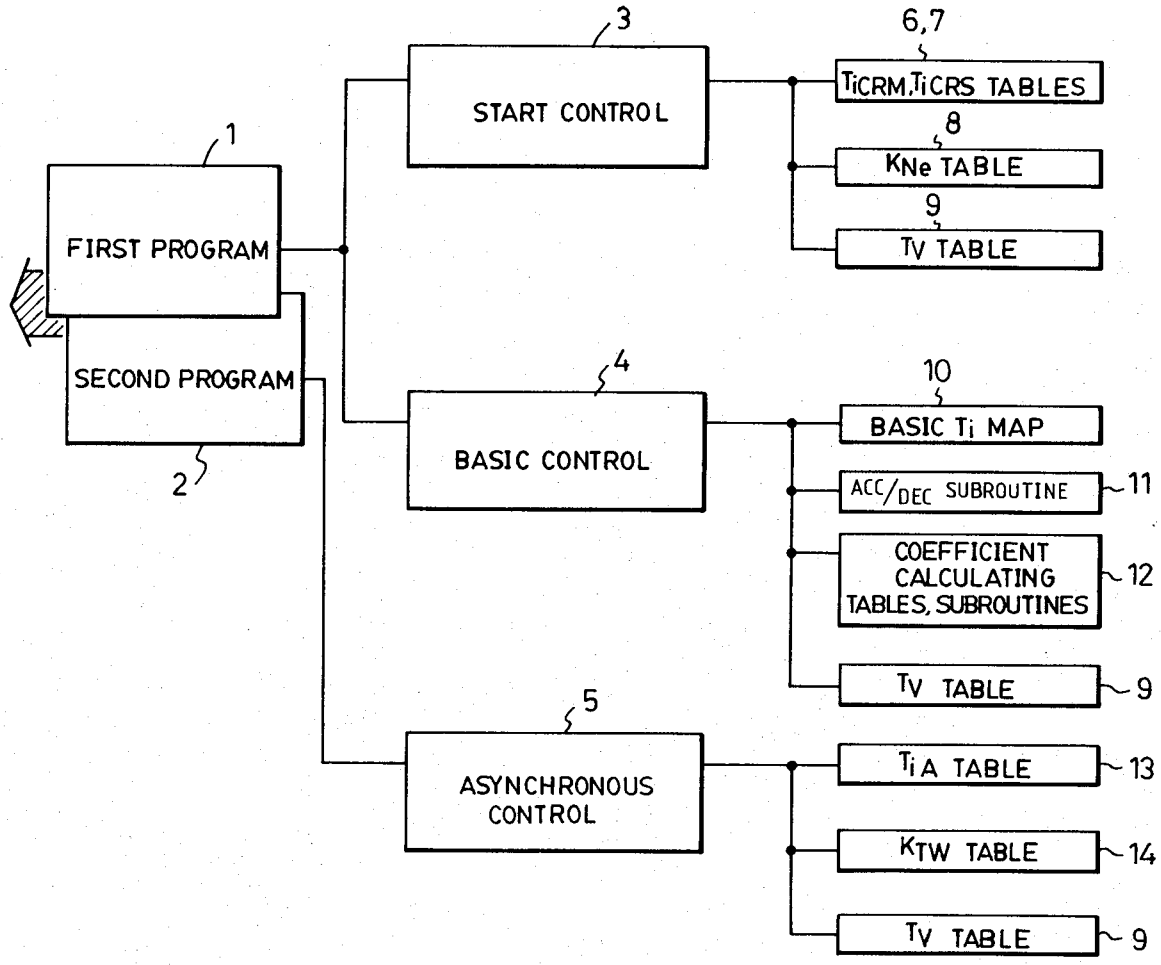
FIG. 2 is a block diagram illustrating a program for control of the valve opening periods TOUTM and TOUTS of the main injectors and the subinjector, which is incorporated in the electronic control unit (ECU) in FIG. 1.

FIG. 2 shows a block diagram showing the whole program for air/fuel ratio control, i.e., control of the valve opening periods TOUTM and TOUTS of the main injectors and the subinjector, which is executed by the ECU 5. The program comprises a first program 1 and a second program 2. The first program 1 is used for fuel quantity control in synchronism with the TDC signal, hereinafter merely called "synchronous control" unless otherwise specified, and comprises a start control subroutine 3 and a basic control subroutine 4, while the second program 2 comprises an asynchronous control subroutine 5 which is carried out in asynchronism with or independently of the TDC signal.

In the start control subroutine 3, the valve opening periods TOUTM and TOUTS are determined by the following basic equations:

$$TOUTM = TiCRM \times KNe + (TV + \Delta TV) \quad (1)$$

$$TOUTS = TiCRS \times KNe + TV \quad (2)$$

where TiCRM and TiCRS represent basic values of the valve opening periods for the main injectors and the subinjector, respectively, which are determined from a TiCRM table 6 and a TiCRS table 7, respectively, KNe represents a correction coefficient applicable at the start of the engine, which is variable as a function of engine rpm Ne and determined from a KNe table 8, and TV represents a constant for increasing and decreasing the valve opening period in response to changes in the output voltage of the battery, which is determined from a TV table 9. ΔTV is added to TV applicable to the main injectors as distinct from TV applicable to the subinjector, because the main injectors are structually different from the subinjector and therefore have different operating characteristics.

The basic equations for determining the values of TOUTM and TOUTS applicable to the basic control subroutine 4 are as follows:

$$TOUTM = (TiM - TDEC) \times (KTAV \times KTW \times KAFC \times KPA \times KAST \times KWOT \times KO_2 \times KLS) + TACC \times (KTA \times KTWT \times KAFC) + (TV + \Delta TV) \quad (3)$$

$$TOUTS = (TiS - TDEC) \times (KTAV \times KTW \times KAST \times KPA) + TV \quad (4)$$

where TiM and TiS represent basic values of the valve opening periods for the main injectors and the subinjector, respectively, and can be determined from a basic Ti map 10, and TDEC and TACC represent constants applicable, respectively, at engine decceleration and at engine acceleration and are determined by acceleration and decceleration subroutines 11. The coefficients KTAV, KTW, etc. are determined by their respective tables and/or subroutines 12. KTAV is an intake air temperature-dependent correction coefficient and is determined from a table as a function of actual intake air temperature, details of which will be described later, KTW a fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $KO_2$ and "$O_2$ feedback control" correction coefficient determined by a subroutine as a function of actual oxygen concentration in the exhaust gases, and KLS a mixture-leaning coefficient applicable at "lean stoich." operation and having a constant value. The term "stoich." is an abbreviation of a word "stoichiometric" and means a stoichiometric or theoretical air/fuel ratio of the mixture.

On the other hand, the valve opening period TMA for the main injectors which is applicable in asynchronism with the TDC signal is determined by the following equation:

$$TMA = TiA \times KTWT \times KAST + (TV + \Delta TV) \quad (5)$$

where TiA represents a TDC signal-asynchronous fuel increasing basic value applicable at engine acceleration and in asynchronism with the TDC signal. This TiA value is determined from a TiA table 13. KTWT is defined as a fuel increasing coefficient applicable at and after TDC signal-synchronous acceleration control as well as at TDC signal-asynchronous acceleration control, and is calculated from a value of the aforementioned water temperature-dependent fuel increasing coefficient KTW obtained from the table 14.

Figure 3:
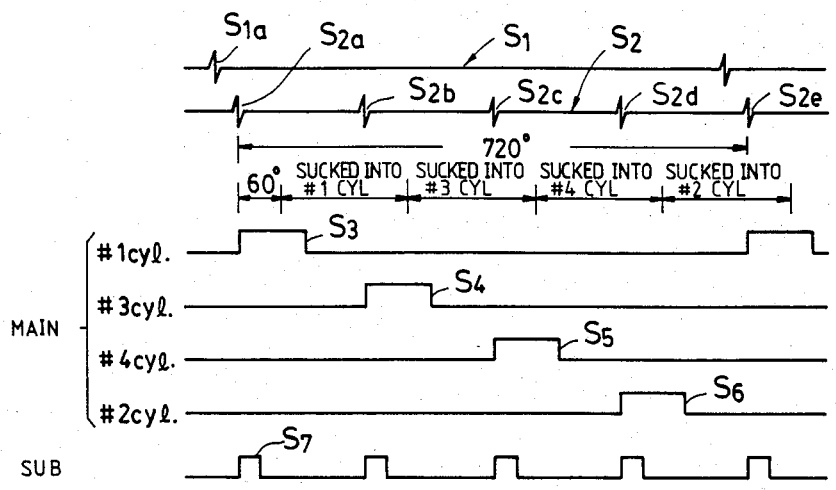
FIG. 3 is a timing chart showing the relationship between a cylinder-discriminating signal and a top-dead-center (TDC) signal inputted to the ECU, and driving signals for the main injectors and the subinjector, outputted from the ECU.

FIG. 3 is a timing chart showing the relationship between the cylinder-discriminating signal and the TDC signal, both inputted to the ECU 5, and the driving signals outputted from the ECU 5 for driving the main injectors and the subinjector. The cylinder-discriminating signal $S_1$ is inputted to the ECU 5 in the form of a pulse $S_1a$ each time the engine crankshaft rotates through 720 degrees. Pulses $S_2a$–$S_2e$ forming the TDC signal $S_2$ are each inputted to the ECU 5 each time the engine crankshaft rotates through 180 degrees. The relationship in timing between the two signals $S_1$, $S_2$ determines the output timing of driving signals $S_3$–$S_6$ for driving the main injectors of the four engine cylinders. More specifically, the driving signal $S_3$ is outputted for driving the main injector of the first engine cylinder, concurrently with the first TDC signal pulse $S_2a$, the driving signal $S_4$ for the third engine cylinder concurrently with the second TDC signal pulse $S_2b$, the driving signal $S_5$ for the fourth cylinder concurrently with the third pulse $S_2c$, and the driving signal $S_6$ for the second cylinder concurrently with the fourth pulse $S_2d$, respectively. The subinjector driving signal $S_7$ is generated in the form of a pulse upon application of each pulse of the TDC signal to the ECU 5, that is, each time the crankshaft rotates through 180 degrees. It is so arranged that the pulses $S_2a$, $S_2b$, etc. of the TDC signal are each generated earlier by 60 degrees than the time when the piston in an associated engine cylinder reaches its top dead center, so as to compensate for arithmetic operation lag in the ECU 5, and a time lag between the formation of a mixture and the suction of the mixture into the engine cylinder, which depends upon the opening action of the intake pipe before the piston reaches its top dead center and the operation of the associated injector.

Figure 4:
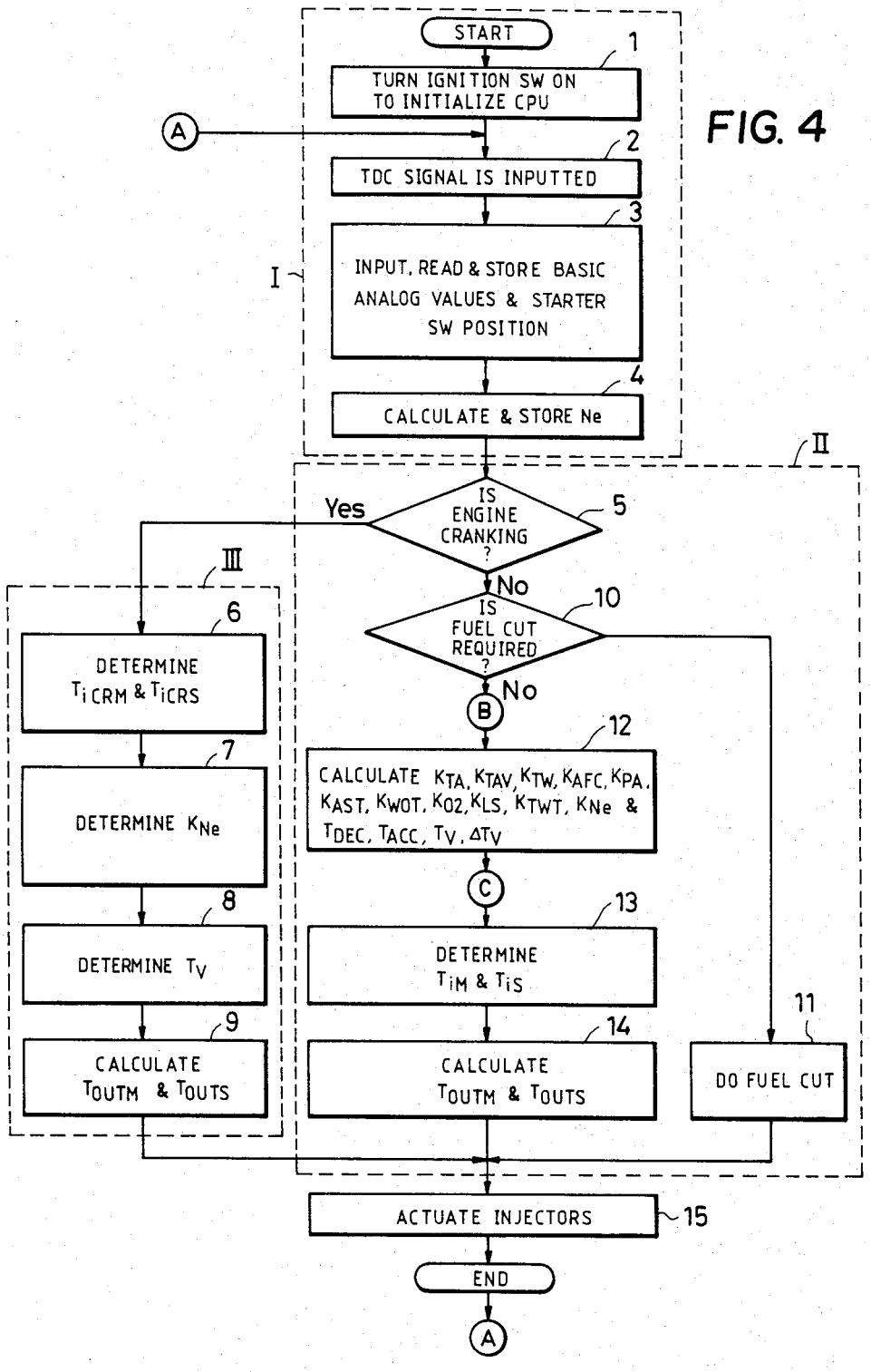
FIG. 4 is a flow chart showing a main program for control of the valve opening periods TOUTM and TOUTS.

Referring next to FIG. 4, there is shown a flow chart of the aforementioned first program 1 for control of the valve opening period in synchronism with the TDC signal in the ECU 5. The whole program comprises an input signal processing block I, a basic control block II and a start control block III. First in the input processing block I, when the ignition switch of the engine is turned on, a CPU in the ECU 5 is initialized at the step 1 and the TDC signal is inputted to the ECU 5 as the engine starts at the step 2. Then, all basic analog values are inputted to the ECU 5, which include detected values of atmospheric pressure PA, absolute pressure PB, engine cooling water temperature TW, atmospheric air temperature TA, throttle valve opening $\theta$th, battery voltage V, output voltage value V of the $O_2$ sensor and on-off state of the starting switch 17, some necessary ones of which are then stored therein (step 3). Further, the period between a pulse of the TDC signal and the next pulse of same is counted to calculate actual engine rpm Ne on the basis of the counted value, and the calculated value is stored in the ECU 5 (step 4). The program then proceeds to the basic control block II. In this block, a determination is made, using the calculated Ne value, as to whether or not the engine rpm is smaller than the cranking rpm (starting rmp) at the step 5. If the answer is affirmative, the program proceeds to the start control subroutine III. In this block, values of TiCRM and TiCRS are selected from a TiCRM table and a TiCRS table, respectively, on the basis of the detected value of engine cooling water temperature TW (step 6). Also, the value of Ne-dependent correction coefficient KNe is determined by using the KNe table (step 7). Further, the value of battery voltage-dependent correction constant TV is determined by using the TV table (step 8). These determined values are applied to the aforementioned equations (1), (2) to calculate the values of TOUTM and TOUTS (step 9).

If the answer to the question of the above step 5 is no, it is determined whether or not the engine is in a condition for carrying out fuel cut, at the step 10. If the answer is yes, the values of TOUTM and TOUTS are both set to zero, at the step 11.

On the other hand, if the answer to the question of the step 10 is negative, calculations are carried out of values of correction coefficients KTAV, KTW, KAFC, KPA, KAST, KWOT, $KO_2$, KLS, KTWT, etc. and values of correction constants TDEC, TACC, TV and $\Delta$TV, by means of the respective calculation subroutines and tables, at the step 12.

Then, basic valve opening period values TiM and TiS are selected from respective maps of the TiM value and the TiS value, which correspond to data of actual engine rpm Ne and actual absolute pressure PB and/or like parameters, at the step 13.

Then, calculations are carried out of the values TOUTM and TOUTS on the basis of the values of correction coefficients, correction constants and basic valve opening periods determined at the steps 12 and 13, as described above, using the aforementioned equations (3), (4) (step 14). The main injectors and the subinjector are actuated with valve opening periods corresponding to the values of TOUTM and TOUTS obtained by the aforementioned steps 9, 11 and 14 (step 15).

As previously stated, in addition to the above-described control of the valve opening periods of the main injectors and the subinjector in synchronism with the TDC signal, asynchronous control of the valve opening periods of the main injectors is carried out in a manner asynchronous with the TDC signal but synchronous with a certain pulse signal having a constant pulse repetition period, detailed description of which is omitted here.

Reference is now made to the intake air temperature-dependent correction coefficient KTAV.

Figure 5:
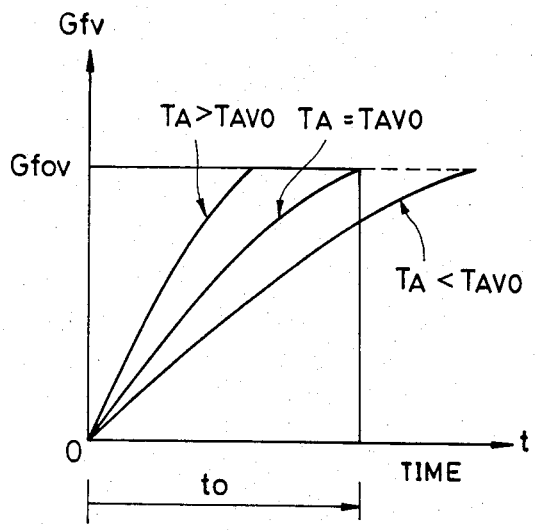
FIG. 5 is a graph showing the relationship between the intake air temperature and the evaporation quantity of fuel droplets, plotted with respect to time.

When the intake air temperature is low, there can occur the phenomenon that the mixture has a leaner air/fuel ratio than a required value due to a reduction in the evaporation rate of fuel. FIG. 5 shows the evaporation quantity of injected fuel. It will be noted from FIG. 5 that the evaporation quantity increases with a lapse of time from injection. In FIG. 5, the gravity or weight of evaporated fuel required for stable engine operation is designated by Gfov, the gravity or weight of injected fuel Gf, and the period of time to between injection and ignition, respectively. If fuel having a quantity Gf is all evaporated within the period of time to, a quantity of fuel equal to the weight Gfov has only to be injected, whereas if it is not all evaporated within the period of time to, the fuel injection quantity has to be increased by an amount corresponding to the amount not evaporated.

The evaporation rate X of fuel droplets per unit time is variable as a function of the total surface area of the fuel droplets, determined by the droplet diameter, and the ambient temperature TA, provided that the injected fuel quantity is constant per unit time. Further, so long as fuel is injected at a constant rate through the same injector or injectors, it can be regarded that the total surface area of the injected fuel droplets remains substantially constant, and therefore, the evaporation rate X is a function of the ambient temperature TA alone. If the gravity of evaporated fuel at the termination of the period of time to is designated by Gfv, the evaporation gravity Gfv can be expressed as follows:

$$Gfv = Gf \times X \times to \quad (6)$$

If a fuel injection quantity or gravity required when the intake air temperature TA is equal to a predetermined reference temperature TAVO is designated by Gfo, this injection quantity Gfo should be set at such a value that the evaporation quantity at the termination of the period of time to is equal to the required amount Gfov, when the intake air temperature TA is equal to the reference temperature TAVO. That is, if the evaporation rate of fuel at the reference intake air temperature TAVO is designated by Xo, the evaporation gravity Gfv per period of time to is expressed as follows:

$$Gfv = Gfov \times Xo \times to$$

When the actual intake air temperature TA is lower than the reference temperature TAVO (TA<TAVO), the evaporation rate X is low. Therefore, if the injection or gravity quantity is equal to the gravity Gfo required at the reference temperature TAVO, the evaporation gravity does not reach the quantity Gfov at the termination of the period of time to. That is, the following relationship stands:

$$Gfo \times XL \times to < Gfov$$

where XL is smaller than Xo.

Therefore, the quantity of fuel being supplied to the engine has to be increased so as to make up for the short evaporation quantity and thereby make the evaporation quantity at the termination of the period of time to equal to the value Gfov. To this end, the correction coefficient KTAV is used so as to satisfy the following equation:

$$KTAV \times Gfo \times XL \times to = Gfov$$

where KTAV should have a value larger than 1.

Figure 6:
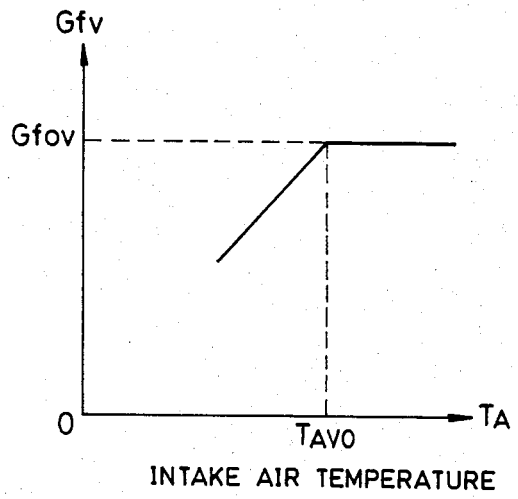

On the other hand, when the actual intake air temperature TA is higher than the reference temperature TAVO (TA>TAVO), the evaporation rate X is larger than Xo, so that evaporation of all the injected fuel is completed by the termination of the period of time to, to obtain an evaporation quantity equal to the value Gfov. That is, when the relationship of TA>TAVO is fulfilled, a fuel quantity equal to the value Gfo suffices for the engine, requiring neither fuel increase nor fuel decrease. On this occasion, the correction coefficient KTAV should be set to 1. The above reference temperature TAVO is set at a value equal to an intake air temperature at which fuel injected into the intake pipe can be completely evaporated within a period of time between the injection of the fuel and the ignition of same. For instance, it can be set at a value within a range from 0° to 20° C. FIG. 6 shows how the evaporation quantity Gfv at the termination of the period of time to varies depending upon a change in the intake air temperature TA, provided that the fuel injection quantity is equal to the value Gfo (constant). FIG. 7 shows how the value of the correction coefficient KTAV should be set, depending upon the change of the intake air temperature, in accordance with the above given consideration.

Figure 8:
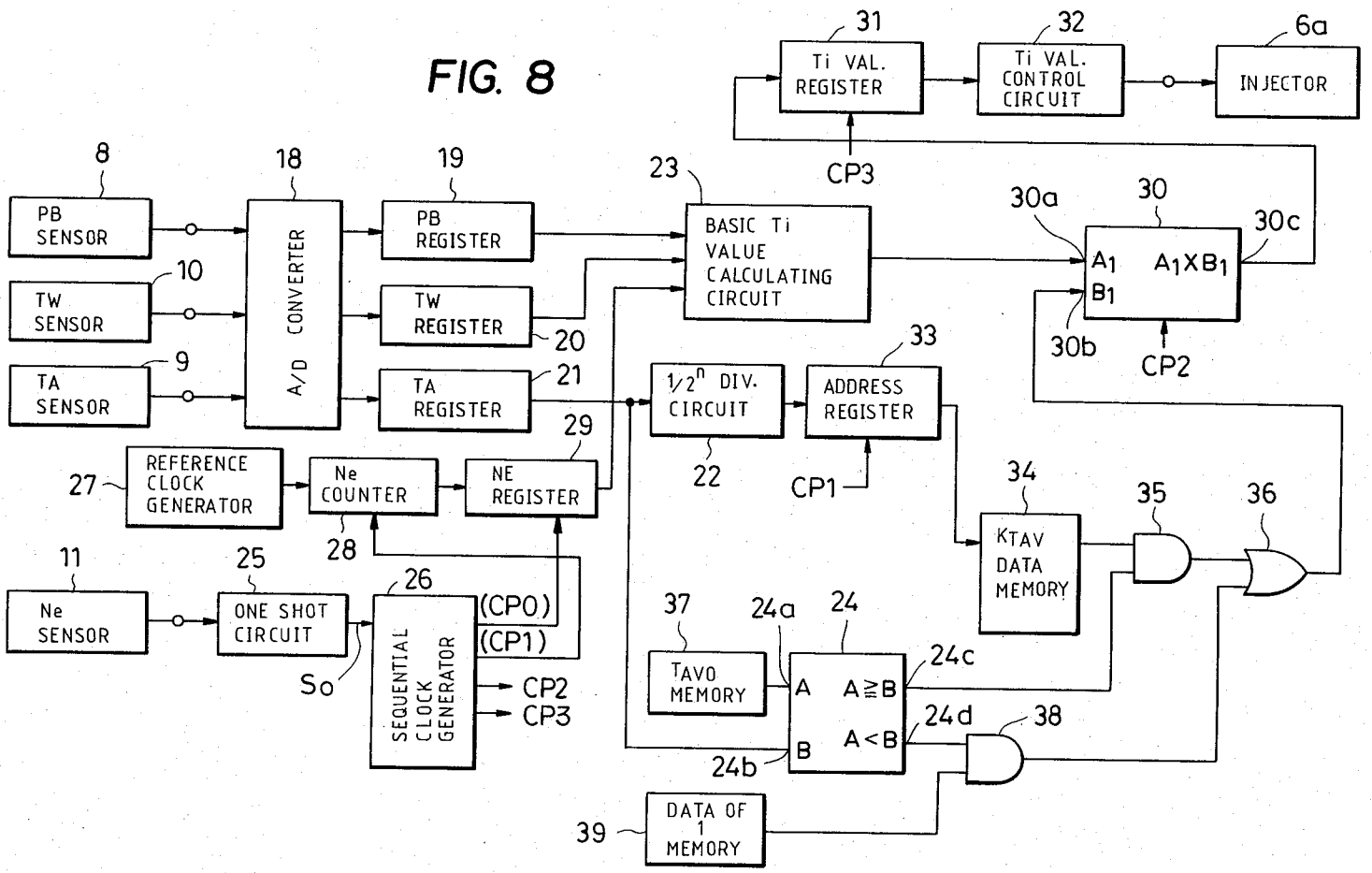
FIG. 8 is a block diagram illustrating the interior arrangement of the ECU.

FIG. 8 illustrates the interior construction of the ECU 5 used in the fuel supply control system described above, showing in particular detail the sections for determining the value of the intake air temperature-dependent correction coefficient KTAV.

In FIG. 8, the intake pipe absolute pressure PB sensor 8, the engine water temperature TW sensor 10 and the intake air temperature TA sensor 9, all appearing in FIG. 1, are connected, respectively, to a PB value register 19, a TW value register 20 and a TA value register 21, by way of an A/D converter unit 18. The engine rpm Ne sensor 11 is connected to the input of a sequential clock generator 26 by way of a one shot circuit 25, and the clock generator 26 has its output connected to the inputs of an Ne value counter 28, an NE value register 29, a multiplier 30, a Ti value register 31 and an address register 33. A reference clock generator 27 is connected to the Ne value counter 28 which in turn is connected to the NE value register 29. Thus, these three circuits are serially connected in the order mentioned. The PB value register 19, the TW value register 20 and the NE value register 29 have their outputs connected to the input of a basic Ti value calculating circuit 23 which in turn has its output connected to an input terminal **30*a* of a multiplier 30. The TA value register 21 has its output connected to the input of a $\frac{1}{2}^n$ dividing circuit 22 and an input terminal 24*b* of a comparator 24. The $\frac{1}{2}^n$ dividing circuit 22 has its output connected to the input of a KTAV value data memory 34 by way of the address register 33. The KTAV value data memory 34 has its output connected to an input terminal of an AND circuit 35 which in turn has its output connected to an input terminal 30*b* of the multiplier 30 by way of an OR circuit 36. The comparator 24 has its other input terminal 24*a* connected to a TAVO value memory 37, its one output terminal 24*c* to the other input terminal of the AND circuit 35, and its other output terminal 24*d* to an input terminal of an AND circuit 38, respectively. Connected to the other input terminal of the AND circuit 38 is a memory 39 storing data of a constant value of 1.0. The AND circuit 38 has its output connected to the above OR circuit 36. The multiplier 30 has its output terminal 30***c* connected to a Ti value control circuit 32 by way of the Ti value register 31. The Ti value control circuit 32 has its output connected to an injector or injectors 6*a* of the fuel injection device 6 in FIG. 1.

The engine rpm Ne sensor 11 in FIG. 1 supplies a TDC signal to the one shot circuit 25 which forms a waveform shaping circuit in cooperation with the sequential clock generator 26 adjacent thereto. The one shot circuit 25 generates an output pulse SO each time a pulse of the TDC signal is applied thereto, and the generated pulse SO is applied to the sequential clock generator 26 to actuate same to generate clock pulses CPO−3, in a sequential manner as shown in FIG. 9. The first clock pulse CPO is supplied to the NE value register 29 to cause a count from the Ne value counter 28 to be loaded thereinto. The counter 28 permanently counts reference clock pulses supplied from the reference clock generator 27. Then, the second clock pulse CP1 is supplied to the Ne value counter 28 to reset its count to zero. Therefore, the engine rpm Ne is measured in the form of the number of reference clock pulses generated and counted between two adjacent pulses of the TDC signal, and the measured value NE is stored into the NE value register 29. Further, the clock pulses CP1−3 are supplied to the address register 33, the multiplier 30, and the Ti value register 31, respectively.

The output signals of the absolute pressure PB sensor 8, the engine water temperature TW sensor 10 and the intake air temperature TA sensor 9 are converted into respective corresponding digital signals by the A/D converter unit 18, and then these digital signals are loaded into the PB value register 19, the TW value register 20 and the TA value register 21, respectively. The basic Ti value calculating circuit 23 operates to calculate a basic valve opening period Ti for the fuel injection valve or valves in the manner previously described with reference to FIGS. 2 through 4, in response to input data indicative of actual intake pipe absolute pressure PB, actual engine water temperature TW and actual engine rpm Ne, supplied from the PB value register 19, the TW value register 20 and the NE value register 29, respectively. The calculated Ti value is supplied to the input terminal 30*a* of the multiplier 30 as an input A1.

The address register 33 stores a plurality of addresses corresponding to a plurality of predetermined values of the intake air temperature which are mapped as shown in FIG. 10. The map shown in FIG. 10 is based upon the relationship between the intake air temperature TA and the value of the correction coefficient KTAV, and is formed by a plurality of predetermined values KTAVi of the coefficient KTAV individually corresponding to the above predetermined intake air temperature values. These predetermined coefficient values KTAVi are experimentally determined. The KTAV value data memory 34 stores these predetermined coefficient values KTAVi in an arrangement individually corresponding to the addresses in the address register 33. A TA value stored in the TA value register 21 is subjected to a division by a number of $2^n$ in the $\frac{1}{2}^n$ dividing circuit 22, into an integral value, and the resulting integral value is applied to the address register 33. Upon application of each clock pulse CP1 to the address register 33, an address value corresponding to the input integral value is read from the address register 33, and then supplied to the KTAV value data memory 34, to read a predetermined value KTAVi therefrom, which corresponds to the input address value. The read value KTAVi is supplied to the AND circuit 35.

In the comparator 24, a comparison is made as to whether or not the actual intake air temperature TA is higher than the predetermined reference value TAVO. More specifically, a TA value from the TA value register 21 is applied as an input B to the input terminal 24*b* of the comparator 24, and a stored value indicative of the reference value TAVO from the TAVO value memory 37 as an input A to the input terminal 24*a* of the same comparator 24, respectively. When the input relationship of $B \leqq A$ stands, that is when the value TA is equal to or lower than the value TAVO, the comparator 24 generates a high level output of 1 through its output terminal 24*c*, and simultaneously a low level output of 0 through its other output terminal 24*d*, respectively. The former output is supplied to the AND circuit 35 to open same, and the latter to the AND circuit 38 to close same, respectively. The opened AND circuit 35 allows the aforementioned read KTAVi value to be applied to the input terminal 30*b* of the multiplier 30 through the AND circuit 35 and the OR circuit 36.

When the input relationship of $A < B$ stands at the comparator 24, that is, when the value TA is higher than the value TAVO, the resultant output of 0 through the output terminal 24*c* closes the AND circuit 35, while the resultant output of 1 through the other output terminal 24*d* opens the AND circuit 38, so that the data value of 1.0 from the memory 39 is supplied to the multiplier 30 through the AND circuit 38 and the OR circuit 36.

In the multiplier 30, a multiplication of the input A1 by the input B1, that is the basic Ti value by the correction coefficient KTAV or the constant of 1.0 is made, and the resultant product $Ti \times KTAV$ or $Ti \times 1.0$ is generated through the output terminal 30*c* and applied to the Ti value register 31. Upon application of each clock pulse CP3 to the register 31, the intake air temperature-corrected Ti value or the non-corrected Ti value is loaded into the Ti value register 31 and simultaneously supplied to the Ti value control circuit 32. The control circuit 32 operates on the input Ti value to generate and supply a driving signal to the injector or injectors 6*a* of the fuel injection device 6, to open same for an injection period corresponding to the input Ti value.

If necessary, the KTAV value data memory 34 may be adapted to also store the constant value of 1.0 as a KTAV value applied when the intake air temperature is higher than the reference value TAVO, and directly connected to the input terminal 30*b* of the multiplier 30, while omitting the comparator 24, the TAVO value memory 37, the 1.0 value memory 39, and the AND circuits 35 and 38. Although in the FIG. 8 arrangement the determination of the KTAV value is made by means of the address register 33 and the KTAV value data memory 34 storing the predetermined values KTAVi, a suitable arithmetic circuit may be alternatively used which is adapted to arithmetically calculate the KTAV value by means of an algebraic operation based upon the relationship between the KTAV value and the intake air temperature shown in FIG. 7.

What is claimed is:

1. In a fuel supply control system for use with an internal combustion engine having an intake pipe, said system including means for determining a basic value of the air/fuel ratio of an air/fuel mixture being supplied to said engine, as a function of at least one parameter representing operating conditions of said engine, an air/fuel ratio correcting device comprising:

a sensor for detecting a value of intake air temperature in said intake pipe of said engine;

means for setting a predetermined value of the intake air temperature which falls within a range of intake air temperature at which fuel injected into the intake pipe of the engine can be completely evaporated within a period of time between the injection of the fuel and ignition of the injected fuel;

means for determining a value of a correction coefficient solely as a function of a value of the intake air temperature detected by said sensor in a manner dependent on a value of the evaporation rate of fuel within said period of time between the injection of the fuel and ignition of the injected fuel, said value of the evaporation rate of fuel being given solely as a function of the intake air temperature, said value of said correction coefficient having (i) a predetermined constant value when the intake air temperature has a value higher than said predetermined value thereof, and having (ii) a value increasing as the intake air temperature has a value thereof decreasing from said predetermined value; and means for correcting a basic value of the air/fuel ratio of said air/fuel mixture determined by said basic value determining means, by multiplying said basic value by an amount corresponding to a value of said correction coefficient determined by said correction coefficient determining means.

2. In a fuel supply control system for use with an internal combustion engine having an intake pipe and at least one electromagnetically controlled fuel injection valve arranged for injecting fuel into said engine and having a valve opening period thereof adapted to determine a quantity of fuel being supplied to said engine, said system including means for determining a basic value of the valve opening period of said fuel injection valve as a function of at least one parameter representing operating conditions of said engine, to thereby control the air/fuel ratio of an air/fuel mixture being supplied to said engine, an air/fuel ratio correcting device comprising:

a sensor for detecting a value of intake air temperature in said intake pipe of said engine;

means for setting a predetermined value of the intake air temperature which falls within a range of intake air temperature at which fuel injected into the intake pipe of the engine can be completely evaporated within a period of time between the injection of the fuel and ignition of the injected fuel;

means storing a plurality of predetermined values of a correction coefficient determined as a function of a value of the evaporation rate of fuel within said period of time between the injection of fuel and ignition of the injected fuel, said value of the evaporation rate of fuel being given solely as a function of the intake air temperature, each of those predetermined values of said correction coefficient which correspond to respective values of the intake air temperature higher than said predetermined value thereof having a constant common value;

means for selectively reading one of said predetermined values from said storing means, which corresponds to a value of the intake air temperature detected by said sensor, those predetermined values of said correction coefficient which correspond to respective values of the intake air temperature lower than said predetermined value thereof being read in a manner increasing with a decrease in the evaporation rate of fuel as the intake air temperature decreases; and means for correcting a basic value of the valve opening period of said fuel injection valve determined by said basic value determining means, by multiplying said basic value by an amount corresponding to a value of said correction coefficient read from said storing means.

* * * * *